US005175970A

United States Patent [19]

Green

[11] Patent Number: 5,175,970

[45] Date of Patent: * Jan. 5, 1993

[54] MOLDED PANEL DOOR WITH INTEGRAL RAISED TRIM

[75] Inventor: F. Richard Green, Hamilton, Ohio

[73] Assignee: Pease Industries, Inc., Fairfield, Ohio

[ * ] Notice: The portion of the term of this patent subsequent to Dec. 24, 2008 has been disclaimed.

[21] Appl. No.: 543,205

[22] Filed: Jun. 22, 1990

[51] Int. Cl.[5] ..... E04C 2/10

[52] U.S. Cl. ..... 52/309.9; 52/458; 49/506

[58] Field of Search ..... 52/455-458, 52/476, 309.9, 309.11, 656; 49/171, 501, 506

[56] References Cited

U.S. PATENT DOCUMENTS

| | | | |
|---|---|---|---|
| 612,366 | 10/1898 | Sears | 52/785 |
| 990,151 | 4/1911 | Mayo . | |
| 2,927,355 | 3/1960 | Rasmussen . | |
| 2,996,767 | 8/1961 | Kobil et al. . | |
| 3,167,823 | 2/1965 | Palfey | 52/309.3 |
| 3,203,052 | 8/1965 | Curtis, Jr. . | |
| 3,287,854 | 11/1966 | Dasovic et al. | 49/501 |
| 3,402,520 | 9/1968 | Lee et al. | 156/78 |
| 3,404,502 | 10/1968 | Miller | 52/455 |
| 3,498,001 | 3/1970 | MacDonald | 49/501 |
| 3,546,841 | 12/1970 | Smith et al. | 52/309.9 |
| 3,599,703 | 8/1971 | Mennuto et al. | 49/501 |
| 3,780,472 | 12/1973 | Biebuyck | 49/501 |
| 3,821,870 | 7/1974 | Sittman | 52/656 |
| 3,903,669 | 9/1975 | Pease, Jr. et al. | 52/455 |
| 3,969,857 | 7/1976 | Stark | 52/208 |
| 4,327,535 | 5/1982 | Governale | 52/309.11 |
| 4,387,545 | 6/1983 | Kern | 52/455 |
| 4,430,836 | 2/1984 | McKann | 52/455 |
| 4,466,220 | 8/1984 | Lewkowitz | 52/127.6 |
| 4,550,542 | 11/1985 | LaSee | 52/476 |
| 4,628,648 | 12/1986 | Winyard | 52/212 |
| 4,643,787 | 2/1987 | Goodman | 52/809 |
| 4,720,951 | 1/1988 | Thorn et al. | 52/455 |
| 4,850,168 | 7/1989 | Thorn | 52/207 |
| 4,856,243 | 8/1989 | Ault et al. | 52/304 |
| 4,882,877 | 11/1989 | Guetle et al. | 52/456 |
| 4,920,718 | 5/1990 | Artwick et al. | 52/476 |
| 5,018,330 | 5/1991 | Lewkowitz | 52/455 |
| 5,074,087 | 12/1991 | Green | 52/309.9 |

FOREIGN PATENT DOCUMENTS

| | | | |
|---|---|---|---|
| 11883 | 8/1902 | Norway | 52/456 |
| 226332 | 12/1924 | United Kingdom | 49/171 |

*Primary Examiner*—James L. Ridgill, Jr.
*Attorney, Agent, or Firm*—Wood, Herron & Evans

[57] ABSTRACT

A panel door includes a pair of compression molded plastic door skins that sandwich a core therebetween, the skins each having a plurality of panels and each panel bordered by integrally formed, raised trim. By cutting along the raised trim and removing the panels associated therewith, on both sides of the door, an opening is formed through the door. The opening is peripherally bordered on both sides of the door by a raised lip left over from the uncut, raised trim. A pair of door light rims sized to fit the opening are connectable from opposite sides of the door to grip a door light within the opening. The rims have outer clamp perimeters that seat outboard of the raised lips, which serve as in-situ locators for mounting the door light rims.

14 Claims, 2 Drawing Sheets

MOLDED PANEL DOOR WITH INTEGRAL RAISED TRIM

FIELD OF THE INVENTION

This invention relates to a panel door, and more particularly, to a panel door made from compression molded door skins having panels bordered by integrally formed, raised trim. The trim facilitates mounting of a variety of different door light arrangements.

BACKGROUND OF THE INVENTION

Many panel doors utilized in building structures utilize an inner core material sandwiched between two outer skins. The inner core material may be wood, particle board, expandable polystyrene or any number of other natural or manufactured substances. Different materials may also be combined to form the core for a panel door. For instance, the outer frame regions may be wood while the internal region may be a less expensive material. The door skins may be either bent or drawn sheet metal, or molded plastic, the skins being preferably finished with paint or varnish to create a wood grain appearance.

The panels of these doors are the regions that are offset by borders of either relieved or raised trim. For a panel door, the number of panels may vary, but the panels are usually located in a predetermined geometric pattern with respect to the shape of the door. Many panel doors also include some combination of panels and door lights, i.e., windows. The door light locations also form a geometric pattern with respect to the panels. One aspect of this invention relates to providing selectability and versatility in arranging the locations of the panels and the door lights of a panel door.

According to one method of mounting a door light to a panel door, the door skins are precut in the locations where the door lights are eventually to be mounted. A pair of the precut skins are then adhesively sandwiched upon a core material, thereby aligning the precut openings of the skins. The door lights are then mounted within the openings to complete the door.

Unfortunately, this method of manufacture requires that the locations of the door lights be known at the outset of production, thereby necessitating a longer lead time because production cannot be initiated until a particular door panel/door light configuration is chosen. While a large number of panel doors of various door light arrangements could be mass produced in an effort to reduce lead time, this solution requires continuous maintenance of a relatively large inventory. If one particular door light configuration were to become unpopular, it would remain in inventory beyond its useful life, resulting in a waste of material. In short, this manner of providing selectability in choosing a door pattern results in delay and possibly, a higher priced panel door.

It is therefore preferable to first sandwich the core with two opposing skins, and then cut the holes for mounting the door lights, after a particular design has been selected. Because this method employs a relatively precise cutting step, care must be taken to assure that holes for mounting the door lights will be in vertical and horizontal alignment with the edges of the door and/or with the other uncut panels of the door. If a cutting error is made, an unsatisfactory door will result, or the material must be scrapped altogether. The requirement for precision cutting translates into an increased labor cost for the final panel door. In a sense, while this method somewhat reduces the lead time associated with manufacturing a panel door with a selected door light configuration, it also produces an increased labor cost in the form of an extra, precise cutting step.

For either of these two methods, the final production step involves mounting the door lights within the prescribed openings. Opposing rims secure the door light to the door within the opening. The rims are connectable from opposite sides of the door and have peripheral regions that contact and clamp upon the door skins on opposite sides of the opening. A bead of hot melt caulking or molding is then applied to the skin around the opening to seal or weatherproof the rims. This molding is shown in FIGS. 7 and 8 of U.S. Pat. No. 3,903,669, a patent owned by applicant.

Unfortunately, while the use of molding is considered necessary to seal the rims, the bead is susceptible to separation from the door skin, and its application represents a labor-intensive production step that results in a higher priced door.

It is therefore an object of the invention to reduce the labor costs normally associated with providing selectability in the arrangement of door panels and door lights in a panel door.

It is another object of the invention to provide a door skin for use in a panel door wherein the skins facilitate secure attachment of a door light.

It is still another object of the invention to provide a versatile door skin that may be advantageously utilized in any one of a variety of selectable panel/door light configurations.

SUMMARY OF THE INVENTION

This invention contemplates a molded door skin with a plurality of panels, each of the panels bordered by integrally formed, raised trim that protrudes outwardly with respect to one of the surfaces, the surface that will become one of the exteriorly directed surfaces of the finished, panel door.

With two such panels sandwiched upon a core, a plurality of panel cross sections are formed. An opening substantially concentric with the former location of at least one of the panel cross sections is formed by cutting through the skins and core along an inner periphery of the raised trim associated with the panel or panels, and then removing the skin and core material therebetween. This produces a raised lip that substantially surrounds the opening, the raised lip being a left-over portion remaining after the raised trim has been cut.

The raised lip serves as an in-situ locator that facilitates subsequent mounting of a rim to the skin. The raised lip also alleviates the need to apply a separate bead of molding or caulking around the opening to weatherproof the rim. If only one panel is removed and a door light is to be sized to occupy the opening that remains after the single panel is removed, the raised lip completely surrounds the opening, and acts as a seal that keeps water out of the core of the door. If more than one panel is removed from a door light, a weatherproofing bead is preferably applied in alignment with the raised lip.

In accordance with a preferred embodiment of the invention, a panel door with one or more door lights mounted therein includes two compression molded plastic door skins that sandwich a wood periphery and a foamed central core. Each of the skins has a plurality of panels, and each panel has an integrally molded border that includes raised trim which protrudes outwardly from one surface of the door skin. When sandwiching the core, the panels of the skins are aligned to form panel cross sections. According to one preferred embodiment, each skin has six rectangular panels, including a lower pair and a middle pair of vertically oriented, elongated panels and an upper pair of panels with a relatively shorter vertical dimension. For reasons to be explained later, the panels of one or more of the pairs may have a slightly greater width than the other panels.

By cutting along the raised trim and removing one or more of the panel cross sections, a door light may be mounted to the door in a selectable location, a location which is geometrically configured or aligned with respect to the remaining, uncut panels. For a door light that occupies only one of the panel cross sections, the cutting and removing step forms an opening completely surrounded by a raised lip, the raised lip being left over from the uncut raised trim. Opposing door light rims connect together from opposite sides of the door to hold a door light in place within the opening. The rims are oversized with respect to the opening and have internal and external clamp perimeters. When connected from opposite sides of the door, the inner clamp perimeters grip a door light from opposite sides to hold the door light in place. The outer clamp perimeters seat exteriorly of the raised lips that border the opening. Preferably, the outer clamp perimeters have cross sectional shapes that fit snugly over the raised lips to maintain the position of the rims.

Because the outer clamp perimeters extend outwardly of the raised lips, the door light rim necessarily extends slightly beyond the other uncut panel cross sections that were initially in vertical alignment therewith. If it is known beforehand which one or more of the vertically aligned panel cross sections are to be removed for mounting of door lights, the skins may be molded so that the other remaining panels will have a slightly greater width. This greater width somewhat compensates for the horizontal extension of the rim, so that the outward protrusion is not readily apparent when looking at the door. Applicant has found that a panel width increased by ¼", i.e., ⅛" on each side, has proved suitable for this purpose. However, if desired, the panels could also be molded to extend a ¼" width on each side, thereby directly aligning the outer perimeters of the mounted light rims with the raised trim of the uncut panel cross sections.

In order to form a panel door with mounted door lights in accordance with a preferred embodiment of the invention, a pair of fiber reinforced polyester door skins are compression molded. The two door skins are then adhesively secured together upon a core material, preferably sandwiching a wood perimeter and an insulator in the central regions of the door. The sandwiching step aligns the panels of each of the skins to form panel cross sections.

When it is determined which and how many of the panel cross sections are to be removed and replaced by door lights, the raised trim surrounding the appropriate panel cross section or cross sections is/are cut and the skins and core material associated therewith are then removed. This cutting step forms an opening located where the panel cross section or cross sections was/were previously located, the opening substantially surrounded by a raised lip left over from the cut trim.

If a door light is to occupy the cross-sectional area of one panel cross section, the raised lip will completely surround the opening. If a door light is to occupy two adjacently situated panel cross sections, and the area therebetween, some cutting must be performed beyond the molded trim of one panel cross section and through the unpaneled portion of the skin and into the aligned molded, raised trim of the next adjacently situated panel.

Similarly, if a door light is to occupy the space from four panel cross sections, and the area therebetween, the cut must surround all four of the panel cross sections and the door skin areas residing therein. Regardless of the number of panel cross sections removed, the resulting opening will be substantially concentric with the former position of at least one of the panels, and the resulting raised lip will substantially surround the opening, on both external surfaces of the door.

A pair of connectable door light rims are then brought together from opposite sides of the door upon a door light within the opening. The rims have inner clamp peripheries that grip the door light therebetween and outer clamp perimeters that seat exteriorly of the raised lips. Preferably, the rims are connected by tightening mounting screws through aligned holes.

The raised lips that substantially surround the opening serve as in-situ locators which facilitate mounting of a door light to the door. The integrally formed raised lips alleviate the need to separately apply a bead of molding or caulking around the opening to mount the door light rim, thereby eliminating a labor step and the cost of the bead material. The raised trim also facilitates precise cutting of the openings at the positions where the door lights are to be mounted. Finally, because the raised lip is integral with the door skin, it is not susceptible to separation from the door, a problem that currently exists when a bead alone is applied for weatherproofing.

Another advantageous aspect of the invention relates to the versatility in the number of door light arrangements that may be mounted to one standard, panel door made from compression molded skin.

In addition to increased versatility, the invention streamlines the method of manufacturing a panel door with door lights, resulting in reduced costs.

These and other features of the invention will be more readily appreciated in view of the following detailed description and the drawings.

DETAILED DESCRIPTION OF THE DRAWINGS

Figure 1:
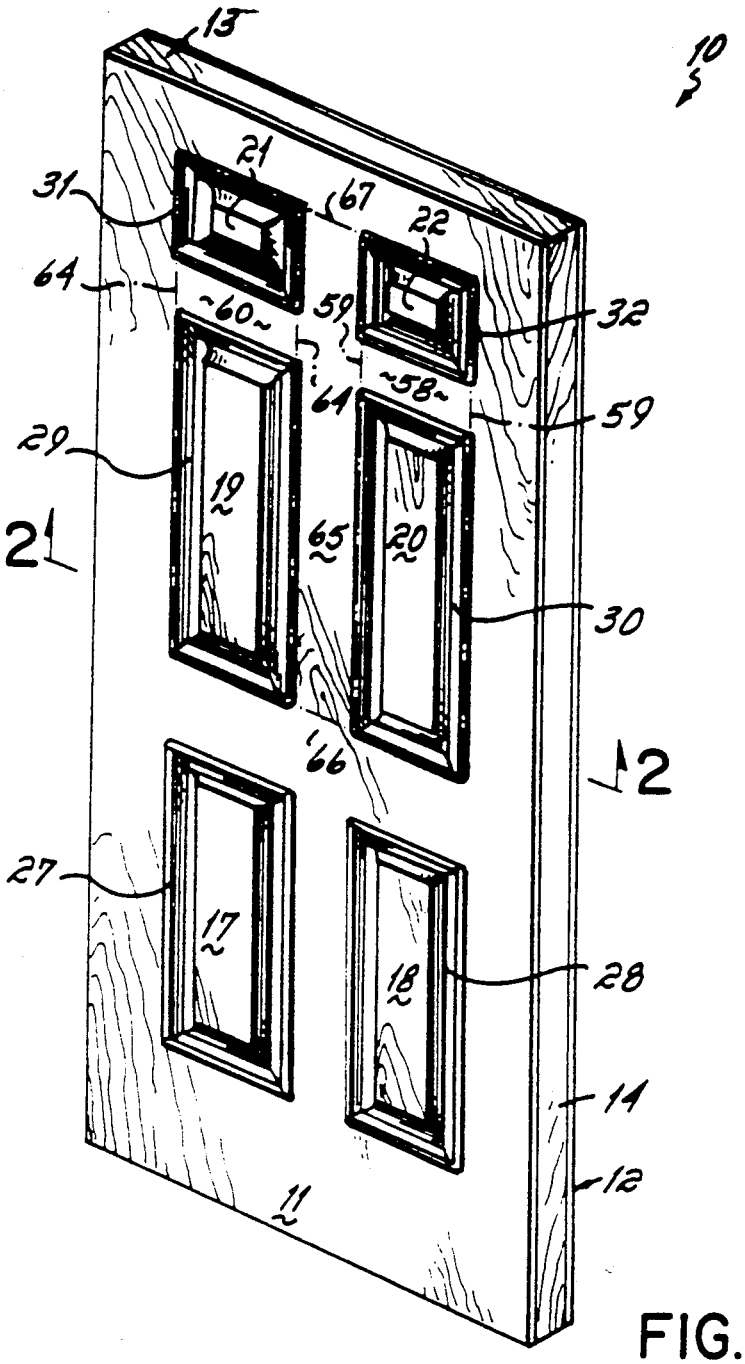
FIG. 1 is a perspective view of a panel door to which one or more door lights are to be mounted in accordance with a preferred embodiment of the invention.
Figure 2:
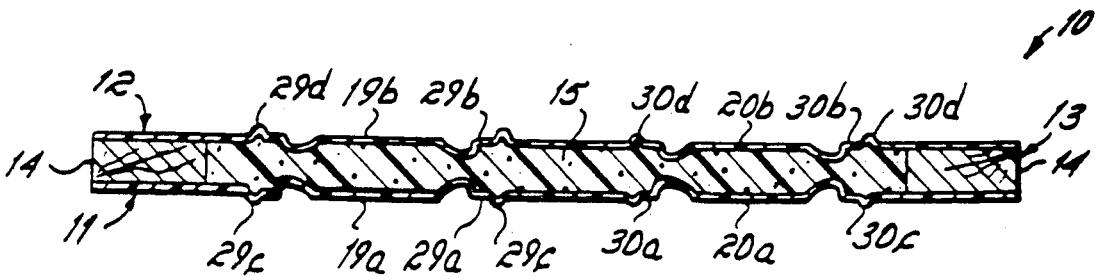
FIG. 2 a cross-sectional view taken along lines 2—2 of FIG. 1.

FIG. 1 shows a panel door 10 that has been formed in accordance with a preferred embodiment of the invention, prior to cutting and removal of selected panels for the purpose of mounting one or more door lights thereon. The door 10 includes molded door skins 11 and 12 which sandwich a core 13. Preferably, the skin material is compression molded fiber reinforced polyester. This preferable material is 45-50% calcium carbonate, by weight, 20-40% fiberglass, by weight, 10-20% polyester resin, by weight, 1% zinc stearate, by weight and 0-1% pigment, by weight. Core 13 may be of any material that provides sufficient support for the door. Preferably, as shown in FIG. 2, the external periphery of the door 10 has a core of wood 14, with a modified expandable polystyrene 15 utilized in the central region. Expandable polystyrene material may be molded to the proper shape and is preferable because of its insulation capabilities and relatively low cost. However, the physical materials utilized for the door skins 11 and 12 and/or the core are not particularly pertinent to the invention, so long as the skins have a cross sectional shape that enables the invention to be produced.

Door skins 11 and 12 include a plurality of panels. When sandwiched on the core 13, the panels from the separate skins are aligned to form panel cross sections Numerals 17, 18, 19, 20, 21 and 22 designate the rectangular panel cross sections shown in FIG. 1. Preferably, door 10 has a lower pair of vertically oriented, elongated panel cross sections 17 and 18, middle pair of vertically oriented, elongated panel cross sections 19 and 20, and an upper pair of panel cross sections 21 and 22 that are relatively shorter in vertical dimension. The planar surface of each of the panels may be contiguous with, recessed from, or protruding outwardly from the external surface of respective door skins, though it is generally preferable that all the planar surfaces be located in the same plane.

When specifically referring to the panels of skin 11, the letter "a" will be appended to the corresponding panel section number. Similarly, the letter "b" will be used to designate panels from skin 12. Each panel is surrounded peripherally by a border. The borders are designated generally by numerals 27, 28, 29, 30, 31 and 32 corresponding to panels 17, 18, 19, 20, 21 and 22, respectively. The letters "a" and "b" are also appended to numerals 27-31 when referring to the particular skins for which the borders are associated. An external portion of each border protrudes outwardly from the outwardly directed skin surfaces of the door 10. This external portion of the border is referred to as the raised trim. These raised trim border portions are indicated by appending a "c" or "d" onto the border numerals 27, 28, 29, 30, 31 and 32, with "c" indicating raised trim of skin 11 and "d" indicating raised trim of skin 12, as shown in FIG. 2. Although a wide variety of border configurations would be suitable, it is important that the outermost peripheral portion of each border protrude outwardly from the outwardly directed surfaces of the sandwiching door skins.

Figure 3:
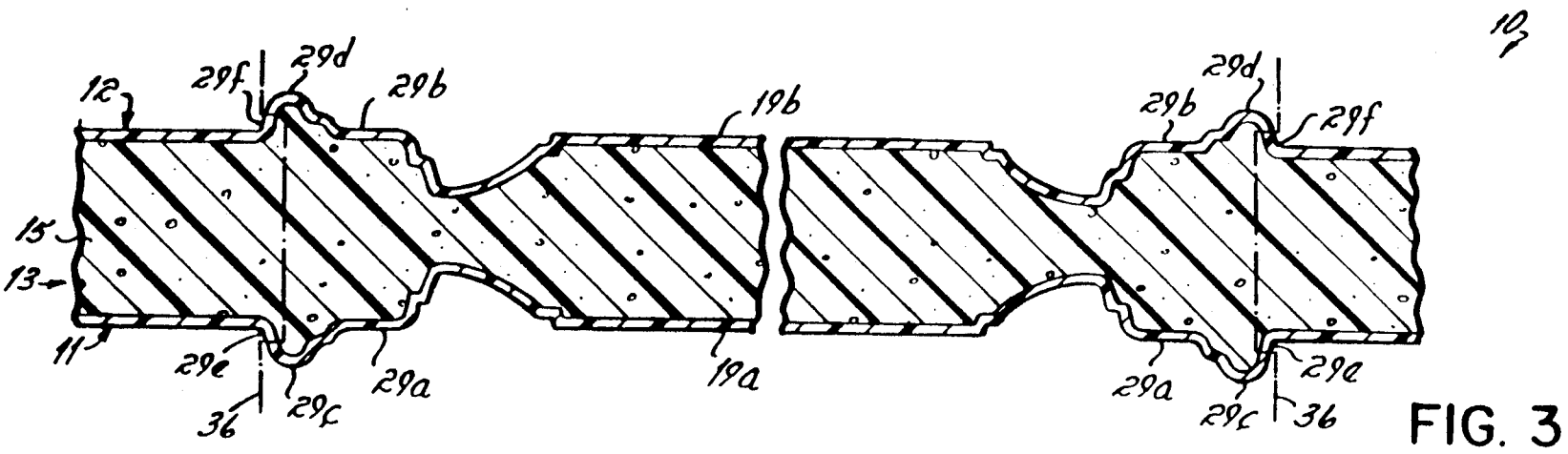
FIG. 3 is an enlarged partial cross-sectional view that shows a cut line through a panel door.
Figure 4:
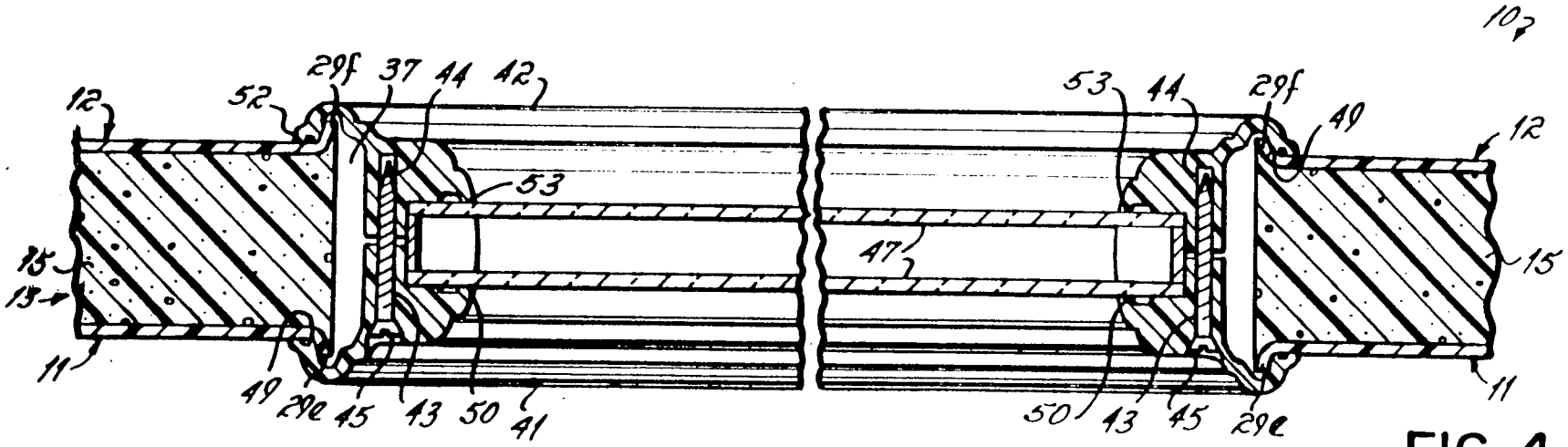
FIG. 4 is an enlarged partial cross-section, similar to FIG. 3, which shows a door light mounted to a panel door in accordance with a preferred embodiment of the invention.

Cutting away of an internal peripheral portion of the raised trim produces a raised lip which is ultimately used for locating, seating and sealing a rim for mounting a door light to a door, as shown in FIGS. 3 and 4. FIG. 3 shows a cut line 36, which indicates the location where the door 10 will be cut. After cutting around a panel by cutting along the border of a panel cross section, i.e.., border 29 in FIG. 3, the disconnected panels 19*a* and 19*b*, most of the borders 29*a* and 29*b*, including most of raised trim 29*c* and 29*d*, and core material 15 located therebetween are removed to form an opening indicated by numeral 37 (see FIG. 4). The only remaining external portions of the borders 29*a* and 29*b* are raised lips left over from the raised trim 29*c* and 29*d*, respectively. These raised lips protrude outwardly from skins 11 and 12 and are designated by numerals 29*e* and 29*f*, respectively.

With the panels and the core material removed, a pair of connectable rims 41 and 42 are centered with respect to the opening 37 from opposite sides of the door 10. Preferably, the rims are connectable by aligned, internally threaded bores 43 and 44 and an externally threaded screw 45. Each rim includes an outer clamp perimeter that seats exteriorly of the raised lip around the opening 37, as shown in FIG. 4. Each rim also has an inner clamp perimeter that grips an outer periphery of the door light 47. As shown in FIG. 4, with respect to one rim 41, outer clamp periphery 49 seats exteriorly of raised lip 29*e* and inner clamp perimeter 50 grips door light 47. With respect to another rim 42, outer clamp perimeter 52 seats exteriorly of raised lip 29*f* and inner clamp perimeter 53 grips door light 47. With the outer perimeters seated exteriorly of the respective raised lips, and the inner perimeters gripping the door light 47 therebetween, the rims 41 and 42 are connected together by screw 45 to complete mounting of the door light 47 to the door 10. As shown in FIG. 4, the external shape of the rims 41 and 42 is substantially similar to the shape of the border that was removed.

If a door light is to be mounted within an opening formerly occupied by only one panel cross section, the left over uncut raised lip will completely surround the opening formed by cutting and removing along the raised trim. However, if a door light is to be mounted within area occupied by two adjacently situated panels along with the surface area located therebetween, cutting of the door skin will not be performed entirely along raised trim, but will also extend around the surface area located therebetween. For example, if panel cross sections 20 and 22 are to be used, area 58 bordered by dashed line 59 must also be removed. For this arrangement, cutting would be performed along line 59, which encircles panels 20 and 22 and most of their respective borders and area 58.

As indicated previously, the standard door panel configuration shown in FIG. 1 provides a wide degree of selectability in determining the location, size and placement of door lights. For instance, panel cross sections 19, 20, 21 and 22 may be removed and replaced by four separate door lights. Alternately, panels 19 and 21 may be removed, and the surface area 60 located therebetween also removed in order to mount a door light having a surface area substantially defined by encircling phantom line 64. For this configuration, it is highly likely that panels 20 and 22 would also be removed, along with surface area 58 residing therebetween, to mount a second door light parallel to the location designated by encircling phantom line 64.

According to still another alternative, panels 19, 20, 21 and 22 may all be removed along with the raised trim within lines 64 and 59, and also area 65 located between lines 66 and 67, thereby to mount a relatively large door light within the opening. A number of other variations would be possible by rearranging the geometric configuration of the individual panel and the locations of the panel cross sections.

In these arrangements, the lip 29 substantially surrounds the opening. In the context of this application, the word substantially means greater than 50% of the opening perimeter.

Outward seating of the outer perimeters of the rims places the rims about a ¼" beyond the raised lips. While outward protrusion of the rim with respect to other aligned panels may be visually noticeable, it is not readily apparent. Nevertheless, it may be desirable to provide oversized panels adjacent to locations of eventual door light mounting, thereby minimizing the misalignment between the raised trim and the rim of an adjacently situated door light. For the configuration shown, this outward protrusion is about ¼". Applicant has learned that an increased panel width of ⅛" on both sides sufficiently reduces the misalignment so as to render it unnoticeable to most observers. In FIG. 1, for instance, panel 17 is shown having a slightly greater width than the panels located thereabove.

While a preferred embodiment of the invention has been described, applicant does not wish to be limited thereby, and it is to be understood that various modifications could be made without departing from the spirit of the invention. Accordingly, it is to be understood that changes may be made without departing from the scope of the invention as particularly set out and claimed.

I claim:

1. A method of forming a panel door having at least one door light comprising the steps of:

molding a pair of plastic door skins, each of the skins having a plurality of panels, and each panel bordered by an integrally formed, raised trim;

sandwiching a core between the door skins, thereby forming a plurality of panel cross sections where the panels of the skins are aligned;

forming an opening through the door by cutting, at selected panel cross sections, along the raised trim of both of the skins and removing the panel cross section associated therewith, the opening being peripherally bordered on each of the outwardly directed surfaces of the skins by a raised lip left over from the respective, cut raised trim;

locating a pair of door light rims over the opening, the rims being connectable from opposite sides of the opening; and inserting a door light between said located rims and mechanically connecting said rims together within the opening and about the inserted door light, thereby to seat said rims outboard of the respective raised lips and to secure said door light within said opening.

2. The method of claim 1 wherein said door skins are molded such that the panels of at least one pair of uncut panel sections are wider than the panels of an adjacently situated pair of cut panel cross sections.

3. The method of claim 1 wherein said removing step further comprises:

forming the opening by removing more than one panel cross section from the skins and the core, thereby to form an opening substantially bordered by an integrally formed raised lip.

4. The method of claim 3 wherein said removing step further comprises:

removing four panel cross sections from the skins and core to define an opening substantially bordered by an integrally formed raised lip.

5. A method of forming a panel door with at least one door light comprising the steps of:

molding a door skin having a plurality of panels, each panel bordered by an integrally formed raised trim; and cutting along the raised trim of at least one of the panels and removing said one panel and most of the raised trim associated therewith to form an opening located substantially concentric with said one panel, the opening being substantially bordered by a raised lip adapted to serve as an in-situ locator and outboard anchor for a door light rim to be mechanically fastened within the opening in order to mount the door light rim to the skin.

6. The method of claim 5 wherein said cutting step is performed along only one panel and the raised lip completely surrounds said opening.

7. The method of claim 5 wherein two adjacently situated panels and the door skin located therebetween are cut to produce said opening.

8. The method of claim 5 wherein four adjacently situated panels and the door skin located therebetween are cut to produce said opening.

9. The method of claim 5 further comprising the steps of:

forming a second door skin similar to the first door skin;

sandwiching a core between the door skins to align the panels and the openings of the skins;

locating a pair of door light rims over one of the openings, the rims being connectable from opposite sides of said opening; and inserting a door light between the located door light rims and connecting the rims together to seat the rims outboard of the respective raised lips and to secure the door light to the door.

10. A panel door with at least one door light comprising:

a molded plastic skin having a plurality of panels, each panel bordered by integrally formed raised trim;

at least one opening in the skin located substantially concentric with the former position of at least one of the panels;

a raised lip substantially surrounding the opening, the raised lip formed by removal of said at least one of the panels and inner portions of the raised trim associated therewith;

a door light rim having inner and outer clamp perimeters, the outer clamp perimeter seated outboard of said raised lip;

a door light gripped by the inner clamp perimeter; and means for mechanically fastening the door light rim to the door, said mechanically fastening means located between said inner and outer clamps.

11. A panel door having at least one door light comprising:

a pair of molded skins, each of the skins having a plurality of panels and each panel bordered by raised trim;

a core sandwiched between said plastic skins to form a plurality of panel cross sections;

at least one opening through said skins and core, the opening located substantially concentric with the former position of at least one of the panel cross sections;

a raised lip substantially surrounding each said opening on outwardly directed surfaces of said sandwiching skins, the raised lips being left over outer portions of the raised trim associated with the respective panels of said at least one of the panel cross sections;

each of the openings further including a pair of door light rims, each door light rim having inner and outer clamp perimeters means for mechanically fastening said pair of door light rims together within said opening, said mechanically fastening means located between the inner and outer clamp perimeter, the outer clamp perimeters seated outboard of the raised lips of the opening when the respective pair of door light rims are mechanically fastened; and a door light gripped between the inner clamp perimeters of each mechanically fastened pair of door light rims.

12. The door of claim 11 wherein each said opening occupies the former position of at least two adjacently situated panel cross sections.

13. The door of claim 12 wherein each said opening occupies the former position of at least four adjacently located panel cross sections.

14. A panel door having at least one door light comprising:

a molded plastic skin with a plurality of panels, each panel bordered by integrally formed trim that is raised with respect to one surface thereof, the skin having at least one opening formed therethrough, each opening located substantially concentric with the former position of at least one of the panels, and each said opening being substantially bordered by a raised lip left over from the raised trim associated with said at least one of the panels, the raised lip adapted to serve as an in-situ locator for an outer clamp perimeter of a door light rim used to mount a door light within said opening.

* * * * *